US005667900A

United States Patent [19]

Kato et al.

[11] Patent Number: 5,667,900

[45] Date of Patent: Sep. 16, 1997

[54] ARAMID PAPER WITH HIGH SURFACE SMOOTHNESS

[75] Inventors: Ippei Kato; Yuji Kimura, both of Shizuoka, Japan; Lee James Hesler, Richmond, Va.

[73] Assignees: E. I. Du Pont de Nemours and Company, Wilmington, Del.; Mishima Paper Ltd., Fuiji, Japan

[21] Appl. No.: 464,819

[22] PCT Filed: Dec. 27, 1993

[86] PCT No.: PCT/JP93/01900

§ 371 Date: Jun. 30, 1995

§ 102(e) Date: Jun. 30, 1995

[87] PCT Pub. No.: WO94/16142

PCT Pub. Date: Jul. 21, 1994

[30] Foreign Application Priority Data

Jan. 4, 1993 [JP] Japan ..... 5-014394

[51] Int. Cl.$^6$ ..... B32B 7/06; B32B 7/08

[52] U.S. Cl. ..... 428/474.7; 428/474.4

[58] Field of Search ..... 428/474.7, 474.4

[56] References Cited

U.S. PATENT DOCUMENTS

| | | | |
|---|---|---|---|
| 4,255,817 | 3/1981 | Heim | 2/2 |
| 4,392,315 | 7/1983 | Irving et al. | 40/27 |
| 4,482,603 | 11/1984 | Yoshida et al. | 428/287 |
| 4,515,656 | 5/1985 | Memeger, Jr. | 162/101 |
| 5,094,794 | 3/1992 | Croman et al. | 264/174 |
| 5,393,601 | 2/1995 | Heinrich et al. | 428/287 |

*Primary Examiner*—Margaret W. Glass

[57] ABSTRACT

Aramid paper with high surface smoothness is offered, wherein [said aramid paper] is characterized by the fact that a surface layer, which contains 100 wt % of poly (metaphenylene isophthalamide) fibrids, which weighs less than 10 g/m$^2$, and which has a coating ratio of 97% or higher, and an intermediate layer, which comprises 70 to 90 wt % of poly(metaphenylene isophthalamide) fibrids and 10 to 30 wt % of poly(metaphenylene isophthalamide) flocks and weighs 20 g/m$^2$ or less, are laminated successively on at least one side of the substrate layer which comprises 25 to 60 wt % of said fibrids and 40 to 75 wt % of said flocks, that the surface smoothness of the surface layer is 40 sec per 10 cc or higher, and that the number of fuzz fibers at least 1 mm long, which are generated by surface friction, does not exceed 5 fibers per 25 cm$^2$. Said aramid paper can be suitably used as electrical insulation paper, heat-resistant labeling paper, heat resistant paper, and the like.

10 Claims, 1 Drawing Sheet

ARAMID PAPER WITH HIGH SURFACE SMOOTHNESS

The present invention concerns an improved aramid paper with satisfactory surface smoothness and reduced fuzzing. In particular, the present invention concerns an especially thin aramid paper suitable for use as electrical insulation paper, heat-resistant labelling paper, and heat resistant paper.

BACKGROUND TECHNOLOGY

Aramid paper is synthetic paper composed of aromatic polyamides. Because of its heat resistance, electrical insulating properties, and flexibility, said paper has been used as electrical insulation paper. Of these materials, Nomex® of Du Pont (U.S.A.) is manufactured by mixing poly (metaphenylene isophthalamide) flocks and fibrids and then subjecting the mixture to hot-press calendering, and is known as electrical insulation paper with excellent electrical insulation papers and with strength which remains high even at high temperatures.

Not only has Nomex® paper, due to its resistance to radiation, been used in electrical equipment designed for nuclear power plants and highly radioactive environments, but its use in high-temperature labels, in which the heat resistance of this type of paper can be utilized, has also been the subject of investigations in recent years. [Such paper,] however, contains highly crystalline poly(metaphenylene isophthalamide) flocks (as has been described above), and these flocks hardly change their shape even when subjected to hot-press treatment. The result is not only that it is impossible to ensure high smoothness of the sheet surface, but also that fuzzing of the surface flocks inevitably occurs, and this impairs the printing properties [of the paper] and limits its applicability as labelling paper. In particular, the paper must have a higher level of surface smoothness than does conventional aramid paper when bar codes are to be printed on such high-temperature labels.

In addition, high-voltage (500,000 V) power transmission has recently been utilized, and the utilization of ultrahigh-voltage (1,000,000 V or higher) power transmission (UHV power transmission) is expected in the near future. Electrical insulation paper to be used in transformers for such high-voltage and ultrahigh-voltage power transmission must have high resistance to fuzzing because even microscopic fuzz fibers (about 50 μm) may cause a local insulation puncture.

Japanese Laid-Open Patent Application 4-6708 discloses an electrical insulation paper whose fuzzing is reduced by the hot pressing of a two-layer structure obtained by laminating synthetic paper; said paper is composed of 100% of poly(metaphenylene isophthalamide) pulp and weighs 10 g/m$^2$ or more. The application also describes synthetic paper which is composed of poly(metaphenylene isophthalamide) pulp and poly(metaphenylene isophthalamide) staple fibers.

However, poly(metaphenylene isophthalamide) fibrids retain water extremely well and drain water poorly, so an increase in the weight of 100% fibrid paper impairs its paper-making properties. In addition, because the synthetic paper thus manufactured is characterized by low tear strength and appreciable thermal contraction, an increase in the proportion of this paper during its lamination and manufacture into electrical insulation paper lowers the tear strength, renders thermal contraction more pronounced, produces sheets which curl readily, and causes other practical problems, which become more evident with a decrease in the weight of the aramid paper as a whole.

When only one side of laminated paper is composed of the above-mentioned 100% fibrid layer, the danger that fuzzing will occur on the other side still remains, limiting the scope of applications. When attempts are made to overcome this drawback by using the above-mentioned 100% fibrid layers on both sides, it becomes difficult to control not only the drawbacks described above, but also the treatment conditions maintained during hot rolling. Specifically, a 100% fibrid layer such as the one described above is less permeable to gases than the above-mentioned layer composed of a mixture of flocks and fibrids, so when hot wiling is performed after 100% fibrid layers have been used on both sides, it is difficult to close the pores inside the sheet, and processing can easily go wrong.

Therefore, whether 100% fibrid layers are located on one side or on both sides, the weight should still be as low as possible.

Because of the reasons described above, conventional aramid paper had surface smoothness which was too low for the paper to be suitable for bar code printing. For example, the Oken-type smoothness of a 2-mil product is 22 sec per 10 cc and gradually diminishes to 14, 7, 4, and 3.5 sec per 10 cc as the thickness of the product increases to 3, 5, 7, and 10 mil. Of the types of paper used for bar code printing, the minimum smoothness of a high-quality paper is 40 to 70 sec per 10 cc. When a bar code is printed on the above-mentioned aramid paper using a thermal transfer printer, many lines are broken even on a 2-mil product, which has the best smoothness, so it is impossible to obtain the same printing quality as with high-quality paper, and products three or more rail in thickness do not withstand use at all. Therefore, a smoothness which is at least comparable to that of the high-quality paper (i.e., 40 sec per 10 cc or higher) is needed for paper to be suitable for printing bar code labels. The smoothness should be 70 sec per 10 cc or higher, and preferably 100 sec: per 10 cc or higher.

DISCLOSURE OF THE INVENTION

Aiming at overcoming prior-art drawbacks such as those described above, the inventors arrived at the present invention as a result of repeated research into the sheet formability of paper composed of 100% of poly(metaphenylene isophthalamide) fibrids and into combinations of said 100% fibrid layers with layers consisting of poly(metaphenylene isophthalamide) flocks and fibrids.

The objective of the present invention is to offer aramid paper with very low fuzzing and high surface smoothness which can be used as electrical insulation paper, high-temperature labelling paper, heat-resistant paper, process paper, and the like.

The poly(metaphenylene isophthalamide) fibrids and poly (metaphenylene isophthalamide) flocks used in the manufacture of the aramid paper pertaining to the present invention are described in U.S. Pat. No. 3,756,908. For example, aramid fibrids, as defined in Japanese Laid-Open Patent Application 4-228696, are "non-granular, filmy particles of an aromatic polyamide with a melting point or decomposition point in excess of 320° C. A fibrid has a mean length of 0.2 to 1 mm and a length-to-width ratio (aspect ratio) of 5:1 to 10:1. The thickness is about several parts of a micron. Such aramid fibrids are used in a wet state and are allowed to precipitate as aggregates that are physically intertwined with the flock component of the aramid paper. Fibrids can be manufactured by the single-step precipitation of a polymer solution using a cutting [sic] fibrid-forming apparatus of the type described in U.S. Pat. No. 3,018,091; said fibrids are not dried until aramid paper itself is dried, nor are they dried to an extent where the filmy structure itself breaks up or where the fibrids adhere to the neighboring structures.

"Similarly, " "flocks" refers to heat-resistant staple fibers that are obtained by cutting from aramid fibers, which may be manufactured by the methods described in U.S. Pat. Nos. 3,063,966, 3,133,138, 3,767,756, and 3,869,430." Du Pont's Nomex® fibrids and Nomex® flocks can be cited as practical examples.

The inventors assumed that surface smoothness can be increased and fuzzing can be prevented by coating with fibrids the flocks that are present on the surface of conventional aramid paper, and conducted research into combinations of surface layers and intermediate layers. Du Pont's Nomex® 5T411 was used as the substrate layer; the intermediate layers used had five levels of the fibrid-to-flock ratio ranging from 90/1 to 50/50 and three levels of weight ranging from 10 to 30 g/m$^2$; and some of the samples that were manufactured were uncoated, while others were coated with a 100% fibrid surface layer whose thickness corresponded to a weight of 5 g/m$^2$. When the surface layer was present, it was combined with the intermediate layer, while when the surface layer was absent, the intermediate layer was first manufactured by a paper-making technique and then superposed on the substrate layer; the laminate was processed by hot calendering under conditions of 300° C. and 250 kg/cm, and made into a sample.

Tables 1 and 2 show the measured smoothness values together with the numbers of fuzz fibers formed following surface friction. Smoothness was measured using an Oken-type smoothness tester, while the number of fuzz fibers formed following surface friction was measured using a color-fastness friction tester (manufactured by Toyo Seiki) in accordance with JIS-L 0823, in which a friction member made of unbleached muslin (cloth No. 3) was rubbed 100 times against the surface of the surface layer or intermediate layer under a load of 500 g and at a reciprocating velocity of 30 cycles per minute; the number of fuzz fibers at least 1 mm long, which formed on the surface as a result of the friction, was visually counted over a surface area of 25 cm$^2$ and was expressed as an average of two samples.

The surface smoothness is higher for samples with surface layers and for samples with higher ratios of fibrids in the intermediate layer. The surface smoothness is especially high when an intermediate layer with a fibrid ratio of 70 to 90 is combined with a surface layer. Therefore, the use of an intermediate layer is effective when a higher value of smoothness is required. When the fibrid ratio is 60 or lower, the results fall within the range observed for ordinary aramid paper. It is evident from these results that smoothness can be increased to a certain degree even when the surface layer is applied directly without the use of an intermediate layer. It was also learned from Table 1 that smoothness tends to decline with an increase in the weight of the intermediate layer.

TABLE 1

| | | Smoothness (sec per 10 cc) | | | | |
|---|---|---|---|---|---|---|
| Weight of surface layer | | 5 g/cm$^2$ | | | No surface layer | |
| Weight of the intermediate layer | | 10 g/m$^2$ | 20 g/m$^2$ | 30 g/m$^2$ | 10 g/m$^2$ | 20 g/m$^2$ |
| Fibrid-to-flock ratio of intermediate layer | 90/10 | 187 | 132 | 60 | 134 | 103 |
| | 80/20 | 119 | 132 | 58 | 70 | 50 |
| | 70/30 | 100 | 119 | 58 | 45 | 24 |
| | 60/40 | 93 | 59 | 38 | 38 | 19 |
| | 50/50 | 88 | 43 | 26 | 23 | 15 |

TABLE 2

| | | Number of fuzz fibers formed following surface friction (number of fibers per 25 cm$^2$) | | | | |
|---|---|---|---|---|---|---|
| Weight of surface layer | | 5 g/cm$^2$ | | | No surface layer | |
| Weight of the intermediate layer | | 10 g/m$^2$ | 20 g/m$^2$ | 30 g/m$^2$ | 10 g/m$^2$ | 20 g/m$^2$ |
| Fibrid-to-flock ratio of intermediate layer | 90/10 | 0 | 0 | 0 | 31 | 35 |
| | 90/20 | 0 | 0 | 0 | 83 | 72 |
| | 70/30 | 0 | 0 | 0 | 138 | 139 |
| | 60/40 | 0 | 0 | 0 | 296 | 242 |
| | 50/50 | 0 | 0 | 0 | 346 | 483 |

The surprising conclusion concerning the number of the fuzz fibers formed was that fuzzing could be prevented in samples coated with a 5 g/cm$^2$ surface layer, irrespective of the compounding ratio and weight of the intermediate layer. For samples with no surface layer, the number of fuzz fibers formed increased sharply with an increase in the content of flocks. For the commercially available Nomex® paper 2T410, the number of fuzz fibers formed was 115 fibers per 25 cm$^2$. Another remarkable feature evident from Table 2 is that the presence of a 5 g/m$^2$ surface layer can prevent fuzzing even when the fibrid compounding ratio of the intermediate layer is 60 wt % or less. Because ordinary aramid paper also has a compounding ratio of 60 wt % or less, it became evident that aramid paper devoid of fuzzing can be manufactured merely by coating the surface of the ordinary aramid paper with a very thin surface layer considered unfeasible in the prior art. A weight of 5 g/m$^2$ is only a half of 10 g/m$^2$, which is considered to be the lower limit in Japanese Laid-Open Patent Application 4-6708. It is not clear why fuzzing can be prevented in the present invention in spite of the fact that the surface layer is very thin; it is believed that the use of Nomex® fibrids contributes considerably to the effect.

The inventors alto conducted research into the coating condition created by the surface layer. A handmade 100% fibrid sheet, which had three levels of fibrid beating degree and five levels of weight (the latter ranging from 3 to 10 g/m$^2$), was manufactured using a paper-making technique in accordance with a procedure similar to that adopted for the 100% fibrid surface layer. Next, a handmade cylindrical sheet sample with a diameter of approximately 15 mm was fixed on a support using weakly adhesive tack paper, gold was vapor-deposited on the sample to a thickness of 500 Å, and the sample was then separated from the weakly adhesive tack paper on the support, yielding an image analysis sample. Specifically, with such an image analysis sample, the gold film which had been deposited in the holes of the handmade sheet remained on the support, so the regions which contained holes and the regions which were devoid of holes could be clearly distinguished by the absence or presence of the gold vapor-deposited film, and image analysis became possible. The image analysis was carried out by using transmitted light in the field of view (approximately 2 mm×2 mm; object×5) of a microscope and selecting a field of view with the maximum number of holes in the sample. The results are shown in Table 3, in which the surface area ratio of that portion of the field of view which is devoid of holes is represented as the coating ratio. Also shown are the results which were obtained by measuring the smoothness of the surface layer and the number of fuzz fibers formed following surface friction. The measurements were performed on aramid paper which was manufactured by the hot-press calendering of a handmade combined sheet (40 g/m$^2$) under conditions of 300° C. and 250 kg/cm. The handmade sheet itself comprised a 100% fibrid surface layer with a beating degree of 61 mL CSF (72° SR), and a layer with a fibrid-to-flock ratio of 40/60 to 60/40.

It was learned that the coating ratio is hardly affected by the beating degree of the fibrids and varies widely with weight. It also became evident that fuzzing cannot be prevented when the weight is 3 g/m$^2$ and can be prevented almost completely when the weight is 4 g/m$^2$ or higher. These figures correspond to a coating ratio of 97% or higher. Said coating ratio is considered to be a quantity which allows one to detect all the defects formed in a sheet during the processes leading the formation of the surface layer, excluding the process of hot-press calendering. This is because the formation of very thin surface layers, as in the present invention, is accompanied by a very serious drawback, namely, the fallout of fibrids during the processes in which fibrids are formed into paper in a wet state from a slurry, dewatered, and dried to yield a sheet. When this happens, it is almost impossible to repair the damaged portions, and these portions are detected as sheet holes. The coating ratio reflects the ability of fibrids to be formed into wet paper, as well as the forming properties of a fibrid sheet as a whole and the physical bondability of the fibrids with each other during the dewatering and drying of the wet paper. Thus, the determination of the coating ratio can be seen as a method for evaluating the characteristics of the fibrids themselves. The fact that the coating ratio of a 100% fibrid sheet weighing 4 g/m$^2$ is 97% or higher can be considered as a distinctive feature of Nomex® fibrids.

TABLE 3

Coating ratios (%) of 100% fibrid surface layers

| Beating degree of fibrids | (1) 61 mL CSF (72° SR)* | (2) 97 mL CSF (66° SR)* | (3) 212 mL CSF (51° SR)* | Smoothness (sec per 10 cc) | Number of fuzz (per 25 cm$^2$) after surface friction |
|---|---|---|---|---|---|
| Weight of 100% fibrid sheet 3 g/m$^2$ | 87.63 | 86.61 | 92.11 | 80 | 30 |
| Weight of 100% fibrid sheet 4 g/m$^2$ | 97.03 | 97.80 | 98.50 | 100 | 2 |
| Weight of 100% fibrid sheet 5 g/m$^2$ | 99.72 | 98.46 | 99.06 | 110 | 0 |
| Weight of 100% fibrid sheet 8 g/m$^2$ | 99.68 | — | — | 150 | 0 |
| Weight of 100% fibrid sheet 10 g/m$^2$ | 100.0 | — | — | 170 | 0 |

*Shopper-Riegler freeness in accordance with JIS P8121

As shown in Table 3, even for a 3 g/m$^2$ surface layer, surface smoothness is relatively high and increases almost linearly with an increase in the weight of the surface layer, thus showing that thicker surface layers are more effective.

However, when a surface layer is made thicker than necessary in a sole attempt to improve the surface smoothness and to prevent fuzzing, the fibrid ratio of the entire sheet becomes too high, not only excessively impairing other physical properties, such as tear strength, thermal contraction, and curling, but sometimes also inhibiting paper-making properties, lowering ease of processing, and causing other manufacturing problems. Restrictions on the thickness of the surface layer exist depending on the application or the manufacturing process, and these restrictions become more severe as the thickness of aramid paper is reduced. A striking example is the electrical insulation paper used in transformers for high-voltage and ultrahigh-voltage power transmission. Since it is used as winding tape, this paper must be highly resistant to fuzzing. In the present invention, this property was evaluated by means of the "number of fuzz fibers longer than 20 μm formed following surface scratching," which was measured by the method described below.

BRIEF DESCRIPTION OF THE DRAWING

The accompanying

As shown in FIG. 1, a piano wire 2 (diameter: 1 mm) bent into a U shape with a radius of curvature of 5 mm is brought into contact with the surface of an aramid paper sample 1 under a load (W) of 360 g, the surface of the aramid paper sample is scratched by forcing [the bent piano wire] to perform 10 cycles of reciprocating motion (shown by the broken arrows in the figure) over a distance of 3 cm or greater along a straight line perpendicular to the tangent line of said bent piano wire, and the number of fuzz fibers whose length exceeds 20 μm and which formed on said straight line over a distance of 3 cm is measured with the aid of a microscope. Such tests, which involve aramid paper samples, are conducted three times in the direction across the paper-making machine, the average is calculated based on the three measured values obtained (unit: number of fuzz fibers per 3 cm), and the result is defined as "the number of fuzz fibers longer than 20 μm formed following surface scratching."

Figure 1:
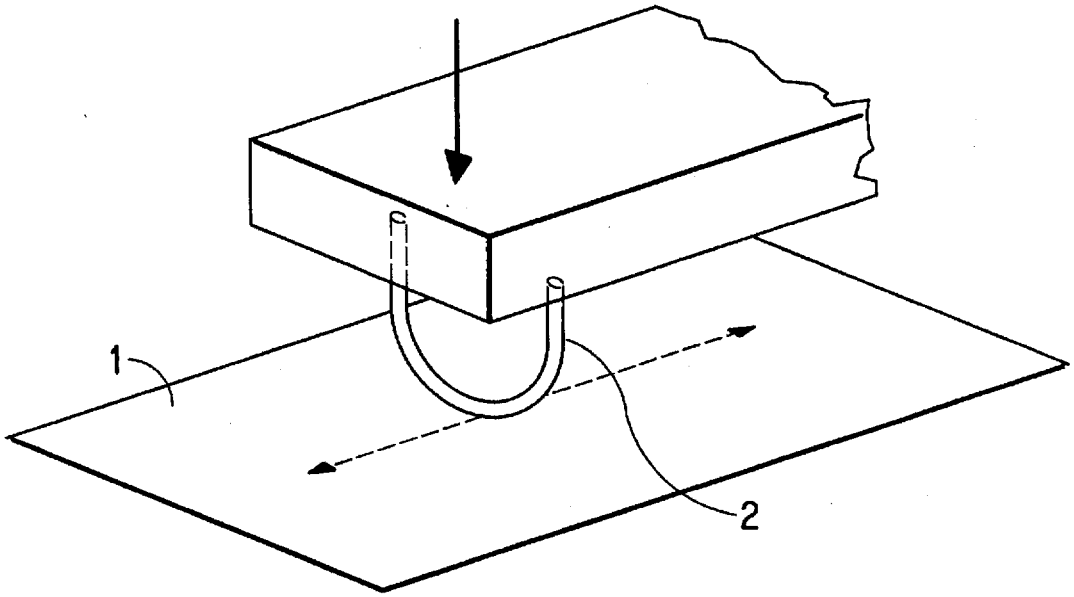
FIG. 1 is an oblique view illustrating the method for measuring "the number of fuzz fibers longer than 20μm formed following surface scratching".

If it is to be used as the electrical insulation paper in transformers for high-voltage and ultrahigh-voltage power transmission, the aramid paper pertaining to the present invention should produce a result according to which "the number of fuzz fibers longer than 20 μm formed following surface scratching" thus measured is no more than 10 fuzz fibers per 3 cm.

Sample I was obtained by forming an 8 g/m$^2$ surface layer (prepared using fibrids with a beating degree of 72° SR) on a substrate layer with a fibrid-to-flock ratio of 30/70. Sample II was obtained by forming a 15 g/m$^2$ surface layer (prepared using fibrids with a beating degree of 44° SR) on the above-mentioned substrate layer. The surfaces of these two samples were scratched in accordance with the test method described above, and the numbers of fuzz fibers formed were compared. The results were as follows: the number of fuzz fibers 20 μm or shorter was 45 fibers per 3 cm for sample I and 59 fibers per 3 cm for sample II; the number of fuzz fibers longer than 20 μm was 4 fibers per 3 cm for sample I and 21 fibers per 3 cm for sample II, of which the number of fuzz fibers 40 μm or longer was 3 fibers per 3 cm for sample I and 13 fibers per 3 cm for sample II, indicating a considerable difference between the samples.

By contrast, the number of fuzz fibers longer than 20 μm was only 2 fibers per 3 cm when similar measurements were performed on a sample obtained by forming an intermediate layer having a weight of 10 g/m$^2$ and a fibrid-to-flock ratio of 80/20 on the same substrate layer, and then forming a surface layer (prepared using fibrids with a beating degree of 72° SR) thereon.

It is important to balance the beating degree of the fibrids with their paper-making qualities in order to form a surface layer containing 100% of fibrids. When beating is light, freeness is high, and paper-making is readily accomplished even with a fairly large weight, but as the beating degree is increased, freeness diminishes, and paper-making qualifies therefore become unsatisfactory.

To beat fibrids means to unravel twisted or balled fibrids as their size is reduced, thereby endowing the resulting sheet with considerable electrical insulation properties. Therefore, the beating degree is high and fibrids can be maintained in an ideal state when the weight is less than 10 g/m$^2$, as is the case in the present invention, but as the weight is increased, beating must be made lighter, and so it becomes impossible to prevent mixed (twisted or balled) fibrids from forming. This difference is believed to affect "the number of fuzz fibers longer than 20 μm formed following surface scratching."

Thus, as the first embodiment, the present invention offers aramid paper with high surface smoothness, which is characterized by the fact that a surface layer, which contains 100 wt % of poly(metaphenylene isophthalamide) fibrids, which weighs less than 10 g/m$^2$, and which has a coating ratio of 97% or higher, and an intermediate layer, which comprises 70 to 90 wt % of poly(metaphenylene isophthalamide) fibrids and 10 to 30 wt % of poly(metaphenylene isophthalamide) flocks and weighs 20 g/m$^2$ or less, are laminated successively on at least one side of the substrate layer which comprises 25 to 60 wt % of said fibrids and 40 to 75 wt % of said flocks, that the surface smoothness of the surface layer is 40 sec per 10 cc or higher, and that the number of fuzz fibers at least 1 mm long, which are generated by surface friction, does not exceed 5 fibers per 25 cm$^2$.

As another embodiment, the present invention offers aramid paper with high surface smoothness, which is characterized by the fact that a surface layer, which contains 100 wt % of poly(metaphenylene isophthalamide) fibrids, which weighs less than 10 g/m$^2$, and which has a coating ratio of 97% or higher, is laminated on at least one side of the substrate layer which comprises 25 to 90 wt % of poly (metaphenylene isophthalamide) fibrids and 10 to 75 wt % of poly(metaphenylene isophthalamide) flocks, that the surface smoothness of the surface layer is 40 sec per 10 cc or higher, and that the number of fuzz fibers at least 1 mm long, which are generated by surface friction, does not exceed 5 fibers per 25 cm$^2$.

It is of course possible in either of the embodiments of the present invention to furnish the surface layers on both sides, to vary the combinations of layers, and to create any laminated structure in which the number of layers in the entire product is three or more.

In the present invention, the surface layer is an indispensable component; the objective of the present invention can be attained with a surface layer weighing 4 g/m$^2$ or more but less than 10 g/m$^2$; when the intermediate layer is absent, the weight should be 5 to 8 g/m$^2$, and preferably 5 to 7 g/m$^2$.

To ensure better smoothness, the intermediate layer must have a fibrid compounding ratio of 70 to 90 wt % and a weight of 20 g/m$^2$ or less. However, since the weight can be reduced by raising the fibrid compounding ratio, a fibrid compounding ratio of 80 to 90 wt % is more suitable.

No restrictions are imposed on the combinations of layers in the aramid paper pertaining to the present invention as long as weight and other necessary physical properties are at a level satisfactory for the intended applications. However, in particular cases involving applications which require thin paper and in which heat resistance, tear strength, curling, and other properties must be taken into account, the surface layer and the intermediate layer should have a weight ratio (as a fraction of the total weight of aramid paper) 67% or lower, preferably 50% or lower, and ideally 5% or lower. In addition, the ratio of fibrid to the entire aramid paper should be 70% or lower, preferably 60% or lower, and ideally 55% or lower. The aramid paper pertaining to the present invention is manufactured in the following manner. Fibrids are prepared into a slurry with the required beating degree using pulpers, beaters, and other devices; flocks are first cut into fibers of the required length and are then made into a slurry in a diffuser, with intertwining being suppressed as much as possible. The slurries are mixed and diluted to obtain the desired compounding ratio, and are then sent to the paper-making process. When the 100% fibrid surface layer pertaining to the present invention weighs less than 10 g/m$^2$, it is especially thin, so said surface layer alone contracts under heat and is impossible to laminate when base paper is formed as a single layer, made into a multilayered structure with other layers, and laminated by hot-press calendering. For this reason, wet combination is selected as the first step of lamination. The surface layer is combined at least with an intermediate layer, and preferably with the substrate layer, into a two- or three-layered structure and dried, yielding base paper. Cylinder or Fourdinier combination paper-making machines, long-cylinder paper-making machines furnished with multilayered inlets or multiple headboxes, and other devices can be used as the multilayered paper-making machines. A three-layered paper-making machine consisting of a cylinder machine and a Fourdinier machine is suitable for the manufacture of thin aramid paper furnished with surface layers on both sides. Because only one substrate layer may be used as the base paper during hot rolling, said hot rolling can be employed to manufacture aramid paper of the desired thickness using various structures, such as a multilayered base paper alone, combinations of several pieces of multilayered base paper, or combinations of multilayered base paper and substrate-layer base paper. The hot rolling is performed continuously using hot calenders; the roll temperature is set at approximately 300° C., which is equal to or higher than the glass transition temperature of poly(metaphenylene isophthalamide); and the roll nip pressure is adjusted depending on the physical properties and other characteristics of aramid paper, and is usually set at 100 kg/cm or higher.

OPTIMUM EMBODIMENTS FOR IMPLEMENTING THE INVENTION

The present invention will now be described using practical examples. The measurements were carried out by the following methods.

(1) Weight. JIS-P8124

(2) Thickness and density. JIS-P8118

(3) Smoothness. J. JAPPI No. 5 (method involves the use of an Oken-type smoothness tester (pressurized type))

(4) Surface roughness. Measured in accordance with JIS-B0601 using a surface roughness gage ("Surfeorder SE-30C," manufactured by Kosaka Kenkyusho), and expressed as a center-line average height (μm)

(5) Tear strength. JIS-P8116

(6) Coefficient of contraction. A sample measuring 2.5 cm×20.3 cm was treated for ten minutes at 250° C. using an oven (PHM-200; manufactured by Tabaiespekku [phonetic rendering]), and the coefficient of contraction (%) was calculated from the length of the sample before and after the contraction. To prevent the sample from wrinkling during the treatment, a metal paper clip (approximately 50 g) was attached to the lower edge of the sample.

(7) Dielectric breakdown strength. JIS C2111

(8) A sheet measuring 15 cm×15 cm (whose moisture was adjusted to 65% RH and [whose temperature was] 20° C.)

was allowed to stand at 80° C. for five minutes using an oven in which hot blast circulated. The curling observed after the sheet had been heated was estimated in the following manner:

○○: Almost no curling

○: Curling occurs, but does not pose a problem

○': Some curling occurs, but use is still possible

Δ: Pronounced curling, emergence of somewhat loose cylindrical formations x: Severe curling, pronounced emergence of cylindrical formations (9) Ease of processing. The manner in which processing defects (blisters) form during the manufacture of a sample by hot-press calendering at 300° C. and 250 kg/cm.

○: None

Δ: Form on portions of at least one sample x : Form on half the samples or more

Practical Examples 1 through 9, Comparative Examples 1 through 8

Nomex® fibrids were made into a slurry with a beating degree of 61 mL CSF (72° SR). Nomex® flocks (avenge fiber length: 6.8 mm) were made into a slurry. The two slurries were then mixed to obtain the compounding ratios shown in Tables 4 through 6 and made into paper in a square-sheet machine (15 cm×25 cm). After the paper had been wetted, layers of wet paper were combined into the structures shown in Table 4 through 6; the structures were first dewatered and then dried at 105° C., yielding base paper for hot calendering.

This base paper was used to manufacture aramid paper by hot-press calendering carried out under conditions corresponding to a temperature of 300° C. and a nip pressure of 250 kg/cm. The physical properties of the sheets are shown in Tables 4 through 6.

When surface roughness was measured to examine surface smoothness on a microscopic level, it was learned that the roughness did not reach the 0.3 μm of the coated paper (smoothness: 2800 sec per 10 cc) and was as low as about half the value of 1.9 μm for high-quality paper (smoothness: 43 sec per 10 cc thus ensuring excellent smoothness on a microscopic scale. The aramid paper pertaining to the present invention displayed excellent printing properties in the course of bar code printing.

Practical Examples 10 through 12

As described above, paper stock was prepared using Nomex® fibrids and Nomex® flocks, and combined base paper was manufactured using a three-layered paper-making machine composed of cylinder and Fourdinier wire meshes. The base paper was subsequently subjected to hot-press calendering under conditions similar to those adopted previously, yielding aramid paper pertaining to the present invention. The structure and physical charateristics of the aramid paper are shown in Table 7.

TABLE 4

| | Practical Example 1 | Practical Example 2 | Practical Example 3 | Comparative Example 1 | Comparative Example 2 |
|---|---|---|---|---|---|
| Surface layer | | | | | |
| FB/FL | 100/0 | 100/0 | 100/0 | 100/0 | — |
| Weight (g/m$^2$) | 5 | 5 | 7 | 5 | — |
| Intermediate layer | | | | | |
| FB/FL | 70/90 | 80/20 | 90/10 | 90/10 | 90/10 |
| Weight (g/m$^2$) | 10 | 10 | 19 | 28 | 10 |
| Substrate layer | | | | | |
| FB/FL | 45/55 | 40/60 | 40/60 | 35/65 | 45/55 |
| Weight (g/m$^2$) | 45 | 45 | 80 | 32 | 30 |
| FB compounding ratio (%) | 53.8 | 51.7 | 54.7 | 63.6 | 56.3 |
| Ease of processing | ○ | ○ | ○ | ○ | ○ |
| Weight (g/m$^2$) | 63.0 | 63.5 | 112.7 | 67.2 | 42.2 |
| Thickness (μm) | 75 | 79 | 130 | 84 | 59 |
| Smoothness (sec per 10 cc) | 100 | 120 | 76 | 119 | 120 |
| Surface roughness (μm) | 1.0 | 1.0 | 0.7 | 1.0 | 1.1 |
| Tear strength (g) | 226 | 237 | 395 | 196 | 144 |
| Dielectric breakdown strength (kV/mm) | 21.4 | 20.9 | 33.5 | 22.6 | 17.4 |
| Coefficient of thermal contraction (%) | 0.56 | 0.52 | 0.55 | 0.65 | 0.56 |
| Number (per 25 cm$^2$) of fuzz fibers 1-mm of longer formed following surface friction | 0 | 0 | 0 | 0 | 35 |
| Curling | ○' | ○' | ○ | X | Δ |

FB/FL = fibrid compounding ratio (%)/flock compounding ratio (%); same below

TABLE 5

| | Comparative Example 3 | Practical Example 4 | Practical Example 5 | Comparative Example 4 | Comparative Example 5 | Practical Example 6 | Practical Example 7 | Comparative Example 6 |
|---|---|---|---|---|---|---|---|---|
| Surface layer | | | | | | | | |
| FB/FL | 100/0 | 100/0 | 100/0 | 100/0 | — | 100/0 | 100/0 | — |
| Weight (g/m$^2$) | 3 | 5 | 8 | 12 | — | 4 | 8 | — |
| Intermediate layer | | | | | | | | |
| FB/FL | — | — | — | — | — | — | — | — |
| Weight (g/m$^2$) | — | — | — | — | — | — | — | — |
| Substrate layer | | | | | | | | |
| FB/FL | 60/40 | 60/40 | 60/40 | 60/40 | 60/40 | 45/55 | 40/60 | 45/55 |
| Weight (g/m$^2$) | 37 | 35 | 32 | 28 | 40 | 36 | 32 | 40 |
| FB compounding ratio (%) | 63 | 65 | 68 | 72 | 60 | 50.5 | 51.0 | 45 |
| Ease of processing | ○ | ○ | ○ | Δ | ○ | ○ | ○ | ○ |
| Weight (g/m$^2$) | 42.0 | 41.5 | 41.8 | 42.1 | 41.9 | 41.4 | 41.2 | 42.5 |
| Thickness (μm) | 58 | 58 | 58 | 58 | 58 | 57 | 57 | 59 |
| Smoothness (sec per 10 cc) | 80 | 110 | 150 | 190 | 30 | 100 | 160 | 18 |
| Surface roughness (μm) | 1.2 | 1.0 | 0.8 | 0.7 | 2.4 | 1.1 | 0.8 | 2.4 |
| Tear strength (g) | 123 | 117 | 110 | 99 | 133 | 158 | 157 | 174 |
| Dielectric breakdown strength (kV/mm) | 18.6 | 19.0 | 19.5 | 20.2 | 18.0 | 16.8 | 17.4 | 15.2 |
| Coefficient of thermal contraction (%) | 0.64 | 0.68 | 0.72 | 0.80 | 0.60 | 0.51 | 0.51 | 0.50 |
| Number (per 25 cm$^2$) of fuzz fibers 1-mm of longer formed following surface friction | 21 | 0 | 0 | 0 | 24.0 | 2 | 0 | 400 |
| Curling | ○ | ○ | ○' | X | ○○ | ○ | ○' | ○○ |

TABLE 6

| | Practical Example 8 | Practical Example 9 | Comparative Example 7 | Comparative Example 8 |
|---|---|---|---|---|
| Surface layer | | | | |
| FB/FL | 100/0 | 100/0 | 100/0 | 100/0 |
| Weight (g/m$^2$) | 5 | 7 | 20 | 10 |
| Intermediate layer | layer | | | |
| FB/FL | 45/55 | 45/55 | 45/55 | 60/40 |
| Weight (g/m$^2$) | 30 | 46 | 64 | 20 |
| Substrate layer | | | | |
| FB/FL | 100/0 | 100/0 | 100/0 | 100/0 |
| Weight (g/m$^2$) | 5 | 7 | 20 | 10 |
| FB compounding ratio (%) | 58.8 | 57.8 | 66.2 | 80 |
| Ease of processing | ○ | ○ | X | Δ |
| Weight (g/m$^2$) | 42.3 | 61.4 | — | 42.3 |
| Thickness (μm) | 59 | 77 | — | 59 |
| Smoothness (sec per 10 cc) | 120 | 140 | — | 160 |
| Surface roughness (μm) | 1.0 | 0.9 | — | 0.8 |
| Tear strength (g) | 137 | 203 | — | 75 |
| Dielectric breakdown strength (kV/mm) | 17.8 | 22.3 | — | 21.8 |
| Coefficient of thermal contraction (%) | 0.58 | 0.57 | — | 0.96 |
| Number (per 25 cm$^2$) of fuzz fibers 1 mm of longer formed following surface friction | 0 | 0 | — | 0 |
| Curling | ○○ | ○○ | — | ○○ |

TABLE 7

| | | Practical Example 10 | Practical Example 11 | Practical Example 12 |
|---|---|---|---|---|
| Surface layer | FB/FL | 100/0 | 100/0 | 100/0 |
| | Weight (g/m$^2$) | 5 | 7 | 8 |
| Substrate layer | FB/FL | 30/70 | 30/70 | 30/70 |
| | Weight (g/m$^2$) | 5 | 7 | 8 |
| Substrate layer | FB/FL | 100/0 | 100/0 | 100/0 |
| | Weight (g/m$^2$) | 5 | 7 | 8 |
| FB compounding ratio (%) | | 66.7 | 66.7 | 66.7 |
| Weight (g/m$^2$) | | 14.8 | 20.5 | 25.7 |
| Thickness (μm) | | 23 | 28 | 33 |
| Smoothness (sec per 10 cc) | | 590/274 | 285/228 | 197/142 |
| Breaking length (along/across) (km) | | 4.66/2.94 | 5.98/3.77 | 6.39/4.28 |
| Tear strength (along/across) (km) | | 14.1/30.3 | 30.6/36.8 | 42.0/58.5 |
| Dielectric breakdown strength (kV/mm) | | 17.6 | 25.4 | 27.8 |
| Coefficient of thermal contraction (along/across) (%) | | 0.62/0.38 | 0.96/0.42 | 1.12/0.60 |
| Number (per 25 cm$^2$) of fuzz fibers 1 mm or longer formed following surface friction | | 0 | 0 | 0 |

The above tables demonstrate that the aramid paper obtained was very thin, displayed excellent surface smoothness, and was devoid of fuzzing.

Thus, the surface layer of the aramid paper pertaining to the present invention can be made very thin, so there is almost no deterioration in the paper-making properties during the manufacture of base paper, the surface is very smooth, and almost no fuzzing is observed following surface friction even when the compounding ratio of fibrids to the entire aramid paper is not made excessively high. The resulting effect is that the paper is suitable for heat processing and that it is possible to prevent tear strength or thermal contraction from deteriorating.

Possibility of Use in Manufacturing

The aramid paper pertaining to the present invention displays excellent heat resistance, electrical insulating properties, and surface smoothness, is almost devoid of fuzzing following surface friction, and exhibits satisfactory printing properties. Another advantage is satisfactory flexibility, made possible by the fact that the paper can be made thin.

Examples of applications for which said paper is suitable include electrical insulation paper, heat-resistant labelling paper, heat-resistant process paper, and other applications which require heat resistance, electrical insulating properties, surface smoothness, and flexibility. The fact that the paper can be made very thin makes it possible to develop additional applications considered unfeasible in the past.

The number of fuzz fibers formed following surface scratching was subsequently measured for the aramid paper pertaining to Practical Example 12 and for aramid paper comprising a surface layer (weight: 15 g/cm$^2$), which was formed using the aforementioned flocks as well as fibrids with a beating degree of 44° SR, a substrate layer with a weight of 25 g/cm$^2$, and a back layer with a weight of 15 g/cm$^2$. According to the results, the number of fuzz fibers longer than 20 μm was 4 per 3 cm for the first type of paper and 21 per 3 cm for the second type of paper, indicating that no considerable difference existed between the two.

In view of the above, the use of the aramid paper pertaining Practical Example 12 as electrical insulation paper in transformers for high-voltage and ultrahigh-voltage power transmission can considerably reduce the possibility of a local insulation puncture.

We claim:

1. An aramid paper with high surface smoothness comprising a substrate layer having laminated on at least one side of the substrate layer a surface layer wherein the weight of the surface layer is less than 10 g/m$^2$ and wherein the surface layer consists of 100 wt % poly(metaphenylene isophthalamide) fibrids and has a coating ratio of 97% or higher and wherein the substrate layer consists of from 25 to 90 wt % poly(metaphenylene isophthalamide fibrids and from 10 to 75 wt % poly(metaphenylene isophthalamide) flock and wherein the surface layer has a surface smoothness of 40 see per 10 cc or higher and has 5 or fewer fuzz fibers of 1 mm in length or more that are generated and measured according to test method JIS-L 0823 per 25 cm$^2$ and wherein the coating ratio is measured by image analysis and is percent of surface area ratio to the field of view that is devoid of holes.

2. The aramid paper with high surface smoothness according to claim 1, wherein the surface layer weights 4 to 8 g/m$^2$.

3. The aramid paper with high surface smoothness according to claims 1 or 2 wherein there are 10 or fewer fuzz fibers longer than 20 μm per 3 cm$^2$.

4. The aramid paper according to claim 1 wherein an intermediate layer is interposed between the surface layer and the substrate layer and the surface layer and the intermediate layer are laminated successively on at least one side of the substrate layer and wherein the intermediate layer weighs 20 g/m$^2$ or less and consists of from 70 to 90 wt % poly(metaphenylene phthalamide) fibrids and 10 to 30 wt % poly(metaphenylene phthalamide) flock and the substrate layer consists of from 25 to 90 wt % % poly(metaphenylene isophthalamide) fibrids and from 10 to 75 wt poly (metaphenylene isophthalamide) flock.

5. The aramid paper with high surface smoothness according to claim 4, wherein the surface layer weighs 5 to 8 g/m$^2$.

6. The aramid paper with high surface smoothness according to claim 4 or 5, wherein said surface layers are laminated on both sides of the substrate layer.

7. The aramid paper with high surface smoothness according to claim 1 or 4, wherein an intermediate layer and a surface layer are successively laminated on one side of the substrate layer, while a surface layer is laminated on the other side of the substrate layer.

8. The aramid paper with high surface smoothness according to claim 7, wherein the surface layer weighs 4 to 8 g/m$^2$.

9. The aramid paper with high surface smoothness as in any of claims 4–8 wherein there are 10 or fewer fuzz fibers longer than 20 μm per 3 cm$^2$.

10. The aramid paper of claim 4 wherein the intermediate and surface layers are laminated successively on both sides of the substrate layer.

* * * * *